US009081368B2

(12) United States Patent
Forsey et al.

(10) Patent No.: US 9,081,368 B2
(45) Date of Patent: Jul. 14, 2015

(54) MECHANISM FOR DRIVING AN INDICATOR

(71) Applicant: GFPI S.A., La Chaux-de-Fonds (CH)

(72) Inventors: Stephen Forsey, Les Brenets (CH); Christoph Neboisa, Schupfen (CH)

(73) Assignee: GFPI S.A., La Chaux-de-Fonds (CH)

( * ) Notice: Subject to any disclaimer, the term of this patent is extended or adjusted under 35 U.S.C. 154(b) by 0 days.

(21) Appl. No.: 14/356,934

(22) PCT Filed: Nov. 9, 2012

(86) PCT No.: PCT/EP2012/072229

§ 371 (c)(1),
(2) Date: May 8, 2014

(87) PCT Pub. No.: WO2013/068519

PCT Pub. Date: May 16, 2013

(65) Prior Publication Data

US 2014/0301171 A1 Oct. 9, 2014

(30) Foreign Application Priority Data

Nov. 11, 2011 (CH) ..... 1803/11

(51) Int. Cl.

| | |
|---|---|
| ***G04B 19/253*** | (2006.01) |
| ***G04B 19/24*** | (2006.01) |
| ***G04B 19/243*** | (2006.01) |
| ***G04B 19/02*** | (2006.01) |

(52) U.S. Cl.

CPC ..... *G04B 19/2534* (2013.01); *G04B 19/02* (2013.01); *G04B 19/24* (2013.01); *G04B 19/2432* (2013.01); *G04B 19/2536* (2013.01)

(58) Field of Classification Search

CPC ..... G04B 19/02; G04B 19/24; G04B 19/25; G04B 47/00

See application file for complete search history.

(56) References Cited

U.S. PATENT DOCUMENTS 5,432,759 A * 7/1995 Vaucher ..... 368/28
5,699,321 A * 12/1997 Vaucher ..... 368/37

(Continued)

FOREIGN PATENT DOCUMENTS

| | | |
|---|---|---|
| EP | 1 351 104 A1 | 10/2003 |
| EP | 1 240 559 B1 | 8/2005 |
| EP | 2 490 084 A1 | 8/2012 |

OTHER PUBLICATIONS

International Search Report, dated Jan. 3, 2013 from corresponding PCT application.

*Primary Examiner* — Amy Cohen Johnson
*Assistant Examiner* — Matthew Powell
(74) *Attorney, Agent, or Firm* — Young & Thompson

(57) ABSTRACT

Mechanism for driving an information indicator connected to a timepiece movement and varies according to a plurality of periods, during each of which the information changes, step by step, to a maximum value that varies between n and n−m. The mechanism includes a drive wheel including a first set of gear teeth arranged to advance by n steps per period, m retractable teeth borne by the wheel, encoding cams corresponding to the retractable teeth, each cam corresponding to one maximum value n−x of the information, x being between 1 and m, for a period, and a drive unit to provide adequate rotation speed to the cams relative to the wheel such that, when the information reaches a maximum value n−x for a period, x retractable teeth pass in an operative position and then return to an inoperative position, the wheel advancing by x additional steps for the period.

13 Claims, 8 Drawing Sheets

(56) References Cited

U.S. PATENT DOCUMENTS

| | | | | |
|---|---|---|---|---|
| 2001/0028604 | A1* | 10/2001 | Watanabe et al. | 368/28 |
| 2012/0210812 | A1* | 8/2012 | Schmidt | 74/414 |
| 2012/0213037 | A1* | 8/2012 | Schmidt | 368/37 |
| 2012/0213038 | A1 | 8/2012 | Schmidt | |
| 2013/0201801 | A1* | 8/2013 | Calabrese et al. | 368/34 |

* cited by examiner

MECHANISM FOR DRIVING AN INDICATOR

TECHNICAL FIELD

The present invention relates to mechanical timepieces. It more particularly relates to a mechanism for driving an indicator of a piece of information connected to a clockwork movement and varying over several periods, during each of which that information evolves by stepping, up to a maximum value varying between n and n−m, said mechanism comprising:

- a first set of first drive pinions supplied with energy by the movement,
- a drive wheel comprising a first toothing arranged to mesh with the first set of first drive pinions to advance by n steps per period,
- a second set of second drive pinions supplied with energy by the movement, the first and second sets of drive pinions being positioned relative to one another such that they do not cooperate at the same time with the drive wheel, and
- m retractable teeth carried by the drive wheel, each being arranged to move between two positions, namely an active position for meshing with one of the second drive pinions of the second set of second drive pinions and advancing the drive wheel by one additional step, and an inactive position for not cooperating with said second drive pinion,
- coding cams, each associated with at least one retractable tooth, and coding wheels secured with said coding cams, the number of coding cams being comprised between 1 and m and the number of coding wheels being less than or equal to the number of coding cams, each coding cam being associated with at least one minimum value n−x of the information, x comprised between 1 and m, for a period, and arranged both to cause the associated retractable tooth to go from the active position to the inactive position and from the inactive position to the active position upon each period for which the maximum associated value of the information is a value comprised between n−m and n−x, and
- drive means arranged to kinematically connect the drive wheel to each of the coding wheels and arranged to impart a suitable speed of rotation to the coding cams relative to the drive wheel, such that, when the information reaches a maximum value n−x for a period, x retractable teeth enter the active position, then return to the inactive position, the drive wheel advancing by x additional steps for that period, n, m and x being natural integers, m being ≥1, preferably m being ≥2.

This drive mechanism can be used in a bracelet watch, as well as a pocket watch, clock or miniature clock.

BACKGROUND OF THE INVENTION

Such a mechanism is for example described in patent application EP 1,351,104, which describes the use of at least one retractable tooth supported by a program wheel, the retractable tooth being associated with a wheel whereof the teeth act as cam surfaces. However, the retractable tooth is a sliding element that is not kept in a given position and that could therefore inopportunely position itself in the active position in case of impact. This would risk causing blockages of the system or breaking the clockwork movement.

Such a mechanism is also described in patent application EP 2,490,084, which describes the use of a retractable tooth mounted pivotably between an active position, in which it is driven by the clockwork movement, and an inactive position, in which it is not driven by said clockwork movement. However, an elastic element is provided making it possible to keep the pivoting retractable tooth in the inactive position. The use of such an elastic element as a return spring is not optimal. In fact, the behavior of this type of part with age is not known. Additionally, in case of rupture or deformation of the elastic element, the mechanism risks no longer working correctly. Furthermore, the retractable tooth, which moves by pivoting, then has an asymmetrical shape. As a result, the retractable tooth will not be able to engage with a wheel having a different pitch diameter, much less in a bidirectional manner, in light of that asymmetry.

Another mechanism for driving a date indicator using a retractable tooth is for example described in patent EP 1,240,559. In this mechanism, to deal with leap years, the use of a retractable tooth is provided subject to a spring to move it and keep it in an inactive or retracted position and kept in the active position for example by an eccentric having a truncated cylinder shape.

Such a mechanism using the action of a spring is not optimal. In fact, in document EP 1,240,559, the spring is mounted against the inner wall of a months wheel. This construction creates friction, which may be quite significant, thereby generating a significant loss of torque. Additionally, the behavior of the spring with age is unknown. The risk is that after a certain amount of time, the retractable tooth will retract incorrectly or be kept in position incorrectly, which could cause poor operation of the system over the long-term. The same is true in case of impact, if the spring becomes deformed. The mechanism then risks no longer working correctly.

One aim of the present invention is therefore to offset these drawbacks, by proposing a springless drive mechanism for managing the entry and exit of the retractable teeth, that is easy to implement, and generates little friction so as to use less energy than the traditional systems.

Another aim of the present invention is to propose a drive mechanism allowing a two-way rotation of the indicator.

Another aim of the present invention is to propose a compact drive mechanism, comprising a reduced number of components and withstanding impacts.

DISCLOSURE OF THE INVENTION

To that end, and according to the present invention, proposed is a mechanism for driving an indicator for a piece of information connected to a clockwork movement and varying over several periods, during each of which said information evolves by stepping, up to a maximum value varying between n and n−m, said mechanism comprising:

- a first set of first drive pinions supplied with energy by the movement,
- a drive wheel comprising a first toothing arranged to mesh with the first set of first drive pinions to advance by n steps per period,
- a second set of second drive pinions supplied with energy by the movement, the first and second sets of drive pinions being positioned relative to one another such that they do not cooperate at the same time with the drive wheel, and
- m retractable teeth carried by the drive wheel, each being arranged to move between at least two positions, namely an active position for meshing with one of the second drive pinions of the second set of second drive pinions and advancing the drive wheel by one additional step, and an inactive position for not cooperating with said second drive pinion, coding cams, each associated with at least one retractable tooth, and coding wheels secured with said coding cams, the number of coding cams being comprised between 1 and m and the number of coding wheels being less than or equal to the number of coding cams, each coding cam being associated with at least one minimum value n−x of the information, x comprised between 1 and m, for a period, and arranged both to cause the associated retractable tooth to go from the active position to the inactive position and from the inactive position to the active position upon each period for which the maximum associated value of the information is a value comprised between n−m and n−x, and drive means arranged to kinematically connect the drive wheel to each of the coding wheels and arranged to impart a suitable speed of rotation to the coding cams relative to the drive wheel, such that, when the information reaches a maximum value n−x for a period, x retractable teeth enter the active position, then return to the inactive position, the drive wheel advancing by x additional steps for that period, n, m and x being natural integers, m being ≥1, preferably m being ≥2.

According to the invention, each retractable tooth comprises a blom stud and the corresponding coding cam associated with a maximal value n−x of the information can comprise a track in which the blom stud can circulate, the track having a suitable configuration for the retractable tooth to remain in its inactive position upon each period for which the associated maximal value of the information is a value comprised between n−x+1 and n, and so that the retractable tooth evolves from its inactive position toward its active position upon each period for which the associated maximal value of the information is a value comprised between n−m and n−x, and then returns to its inactive position after having cooperated with the second drive pinion.

Thus, each retractable tooth moves radially relative to the drive wheel. One advantage of this construction is that the shape of the retractable teeth remains symmetrical when the retractable teeth move such that they can work with other wheels of the movement including different pitch diameters from those of the wheels used in the mechanism according to the invention.

Advantageously, the driving means may comprise a drive organ comprising a drive toothing arranged to cooperate with the drive wheel and a number of driving toothings equal to the number of coding wheels, said driving toothings being arranged to cooperate with the coding wheels, the drive toothing and the driving toothings being chosen so as to obtain a suitable speed ratio between the drive wheel and each of the coding cams.

Preferably, the drive toothing and the driving toothings can be mounted on a same arbor.

Advantageously, the drive wheel may comprise a second toothing to cooperate with the drive means.

Preferably, the coding wheels, the coding cams and the drive wheel may be coaxial.

Advantageously, the first and second sets of drive pinions may comprise a first, second drive pinion, respectively, said first and second drive pinions being secured to each other.

According to one preferred embodiment, in which the drive mechanism is a mechanism for driving a perpetual calendar indicator, said mechanism comprises a first retractable tooth and a first coding cam associated with the 30-day months, a second retractable tooth and a second coding cam associated with the month of February with 29 days, and a third retractable tooth and a third coding cam associated with the month of February with 28 days, the drive wheel being a dates wheel with 31 teeth arranged to advance by one step per day.

Advantageously, the coding cam associated with the 30-day months can be secured to a coding wheel for the 30- and 31-day months, and the coding cam associated with the month of February with 29 days and the coding cam associated with the month of February with 28 days are secured to a same coding wheel for the month of February with 28 and 29 days.

Preferably, the drive means may comprise a drive organ comprising a drive toothing arranged to cooperate with the dates wheel, a first driving toothing arranged to cooperate with the coding wheel for the 30- and 31-day months, and a second driving toothing arranged to cooperate with the coding wheel for the months of February with 28 and 29 days.

The toothings of the dates wheel and drive organ are such that, the dates wheel performing 12 revolutions per year, the coding wheel for the 30- and 31-day months performs 11 revolutions per year, shifting by 30° per month from the dates wheel, and the coding wheel for the months of February with 28 and 29 days performs 47 revolutions in 4 years, shifting by 7.5° relative to the dates wheel.

According to one preferred embodiment, the drive mechanism according to the invention comprises a mechanism for driving an indicator of the day of the week, said mechanism for driving an indicator of the day of the week comprising a days wheel arranged to cooperate with the first toothing of the drive wheel when the retractable teeth are in the inactive position, and to be released from the first toothing of the drive wheel when at least one of the retractable teeth is in the active position.

Advantageously, the mechanism for driving an indicator of the day of the week can further comprise a lever on which the days wheel is mounted and a control cooperating with said lever, said control having a protruding zone arranged to cooperate with at least one of the retractable teeth when the latter are in the active position, so as to lift said control and the lever and free the days wheel from the first toothing of the drive wheel.

BRIEF DESCRIPTION OF THE DRAWINGS

The invention will be better understood upon reading the following description of different embodiments, provided as an example and done in reference to the drawings, in which.

DETAILED DESCRIPTION OF THE INVENTION

In the present description, a period during which the information evolves by stepping may be a noncyclical period, such as the months of a Chinese calendar, or a period forming a cycle, such as the months of the Gregorian calendar, said information given by the indicator for example being able to be the day of the month.

In the example embodiment described below, the information provided by the indicator is the date for the day of the month, the cycle being four years, and the periods of the cycle being the different months of the year. We therefore have n=31 and m=3, the maximum value of the date being 28, 29, 30 or 31 depending on the months and years.

In this example embodiment, the drive mechanism according to the invention is a mechanism for driving a perpetual calendar indicator for a Gregorian calendar, the drive wheel being a dates wheel with 31 teeth arranged to advance by one step per day, that advancement being called a regular advancement.

In the present description, the expression "one additional step" means that the drive wheel advances by one step further, independently of any chronological order relative to the regular advancement by one step per day.

Figure 2:
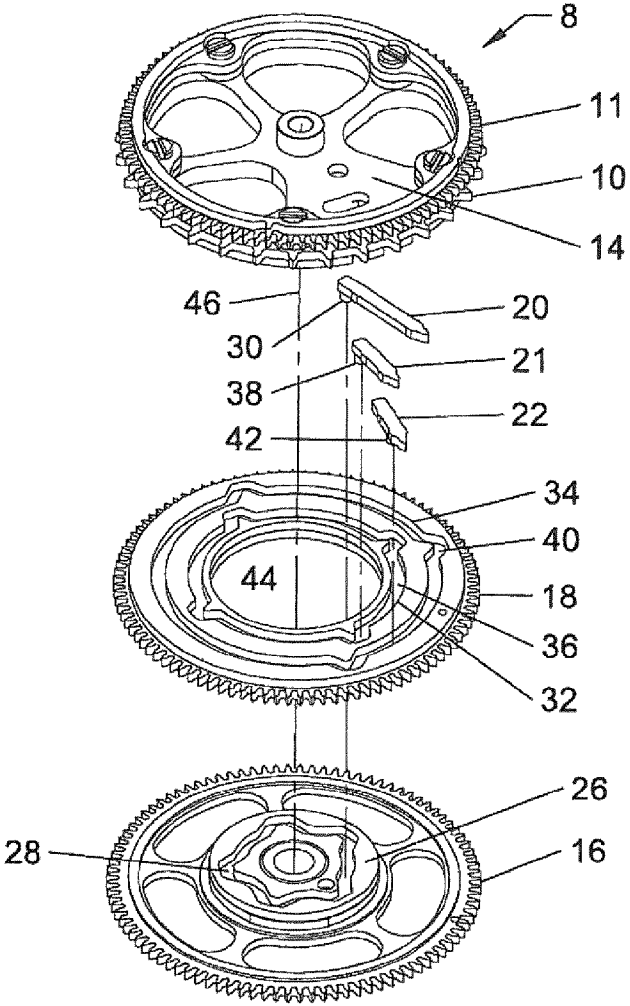
FIG. 2 is an exploded isometric view of FIG. 1.
Figure 1:
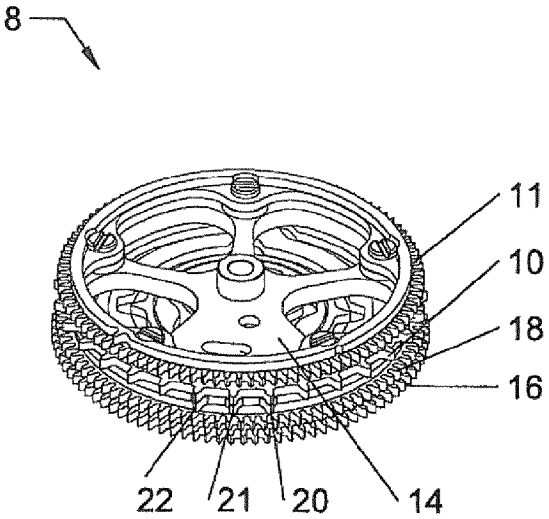
FIG. 1 is an isometric overall view showing the drive wheel and the coding wheels according to the invention.
Figure 4:
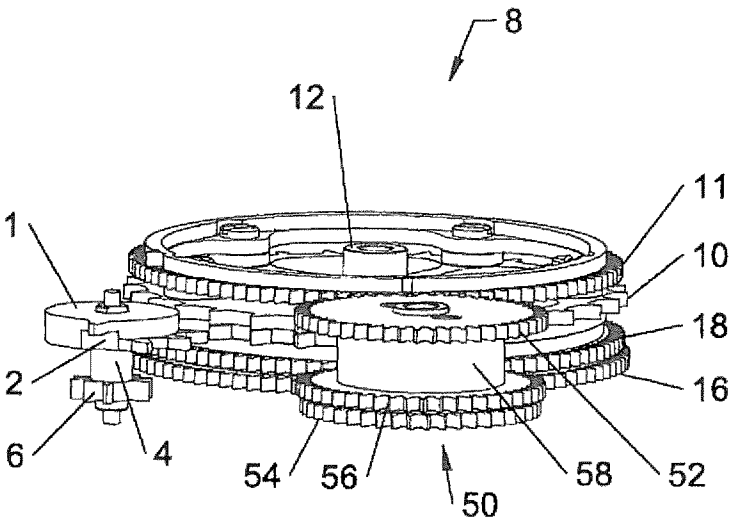
FIG. 4 is an isometric view of FIG. 3.

In reference to FIGS. 1 to 4, a drive mechanism is shown comprising a single first drive pinion 1 with one tooth and a single second drive pinion 2 with three teeth, coaxial and secured to each other. They may be formed in a single piece as shown in FIG. 4, secured to an arbor 4. The first and second drive pinions 1 and 2 are supplied with energy by the movement to which they are kinematically connected by a pinion 6, which is also secured to the arbor 4. The first and second drive pinions 1 and 2 cooperate with the movement so as to perform one complete revolution per day.

Sets of first and second drive pinions comprising one or more teeth may also be used, their speed of rotation being suitable so that the drive wheel advances by the number of steps required. In particular, the set of second drive pinions may comprise several second drive pinions distributed at different locations around the drive wheel.

The mechanism also comprises a drive wheel, and more specifically here, a dates wheel 8, comprising a first toothing 10 with 31 teeth arranged to mesh with the first drive pinion 1. Thus, the dates wheel 8 is driven by one step per day by the tooth of the first drive pinion 1 and performs one complete stepping revolution in one month.

The dates wheel 8 also comprises a second toothing 11 arranged to cooperate with the drive means described below.

The axis 12 of the dates wheel 8 carries an indicator, such as a hand or disc (not shown), cooperating with a thirty-one segment graduation appearing on the dial of the timepiece, said indicator indicating the date.

It is also possible to connect the dates wheel to an indicator positioned in any location of the movement using a gear train or a suitable mechanism.

The teeth of the first and second drive pinions 1 and 2 are positioned relative to one another such that they do not cooperate with the dates wheel 8 at the same time.

Figure 9:
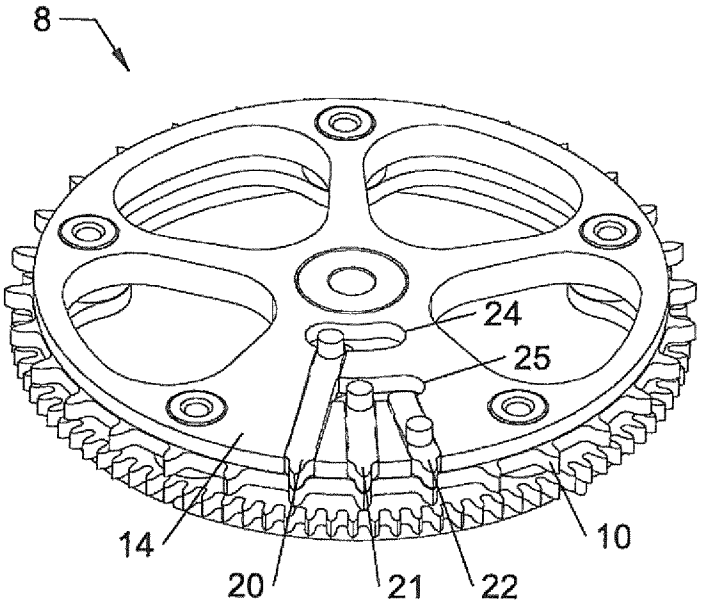
FIG. 9 shows a bottom view of the drive wheel.

As shown more particularly in FIG. 9, the dates wheel 8 comprises a solid surface 14 in which three recesses are provided, across from the coding wheels 16 for the 30- and 31-day months and the coding wheel 18 for the months of February with 28 and 29 days described below. In each of these recesses, a retractable tooth is placed dimensioned such that each retractable tooth can slide radially in the associated recess to move between its active and inactive positions as defined above. It is clear that the retractable teeth could also evolve between more than these two positions. More particularly, the retractable teeth could have several positions that make them able to act on the other wheels having different pitch diameters.

The thickness of the solid surface 14 is sufficient for the retractable teeth positioned in the recesses to be positioned below the first toothing 10 and able to mesh with the second drive pinion 2 when they are in the active position.

In the illustrated alternative, the mechanism comprises three retractable teeth 20, 21, 22, the retractable tooth 20 being associated with the 30-day months, the retractable tooth 21 being associated with the month of February with 29 days, and the retractable tooth 22 being associated with the month of February with 28 days.

Oblong holes 24 and 25 are provided at the end of the recesses to form zones in which the retractable teeth can withdraw to be in the inactive position.

According to the invention, the drive mechanism comprises the coding wheels 16 for the 30- and 31-day months and a coding cam 26, secured to the coding wheels 16 and associated with the retractable tooth 20. The coding cam 26 comprises a track 28 in which a blom stud 30 protruding from the retractable tooth 20 can circulate, toward the coding cam 26. The track 28 has a configuration made from a set of hollows and points, said configuration being suitable for the retractable tooth 20 associated with the 30-day months to remain in its inactive position inside the recess during the 31-day months, and leave its recess and go to the active position during the 28-, 29- and 30-day months, and subsequently return to the inactive position after having meshed with the second drive pinion 2.

The drive mechanism also comprises the coding wheel 18 for the months of February with 28 and 29 days, a coding cam 32 associated with the month of February with 29 days, associated with the retractable tooth 21, and a coding cam 34 associated with the month of February with 28 days, and associated with the retractable tooth 22. In this alternative, a single coding wheel 18 is provided to carry the coding cams 32 and 34 for the months of February, said coding cams 32 and 34 being secured to said coding wheel 18 for the months of February with 28 and 29 days.

The coding cam 32 comprises a track 36 in which a blom stud 38 protruding from the retractable tooth 21 can circulate, toward the coding cam 32. The track 36 has a configuration made from four circular sectors and four pointed sectors separating the circular sectors, distributed regularly. This configuration is suitable for the retractable tooth 21 associated with the months of February with 29 days to remain in its inactive position inside the recess during the months with 31 days and 30 days and to leave its recess and enter the active position for the months of February with 28 and 29 days, and subsequently return to the inactive position after having meshed with the second drive pinion 2.

The coding cam 34 comprises a track 40 in which a blom stud 42 protruding from the retractable tooth 22 can circulate, toward the coding cam 34. The track 40 has a configuration made up of three circular sectors and three pointed sectors separating the circular sectors, two circular sectors extending regularly over 180° and the third circular sector extending over 180°. This configuration is suitable for the retractable tooth 22 associated with the months of February with 28 days to remain in its inactive position inside the recess for the months with 31 days, the months with 30 days, and the months of February with 29 days, and leave its recess and enter the active position for the months of February with 28 days, and subsequently return to the inactive position after having meshed with the second drive pinion 2.

The coding wheel 18 for the months of February with 28 and 29 days comprises a central opening 44, sized to receive the coding cam 26 associated with the 30-day months. Thus, the three tracks 28, 36 and 40 are in a same plane.

The coding wheels 16 for the 30- and 31-day months, the coding wheel 18 for the months of February with 28 and 29 days, the coding cam 26 associated with the 30-day months, the coding cams 32 and 34 associated with the months of February with 29 and 28 days, and the dates wheel 8 are coaxial to the axis 46, the coding wheels 16 and 18 and the dates wheels 8 being mounted freely rotating around the axis 46.

Thus, the drive mechanism according to the invention is very compact.

The coding cam and the associated coding wheel form a coding disc that may be made in a single piece or in the form of two secured pieces.

According to the invention, the drive mechanism also comprises drive means arranged to kinematically connect the dates wheel 8 to each of the coding wheels 16 and 18 and arranged to impart a suitable speed of rotation to the coding cams 26, 32 and 34 relative to the dates wheel 8, such that:

- for a 31-day month, none of the retractable teeth 20, 21, 22 enter the active position,
- for a 30-day month, only the retractable tooth 20 enters the active position, then returns to the inactive position, the dates wheel 8 advancing by one additional step for that month,
- for a month of February with 29 days, the two retractable teeth 20 and 21 enter the active position, then return to the inactive position, the dates wheel 8 advancing by two additional steps for that month,
- for a month of February with 28 days, the three retractable teeth 20, 21 and 22 enter the active position, then return to the inactive position, the dates wheel 8 advancing by three additional steps that month.

Figure 3:
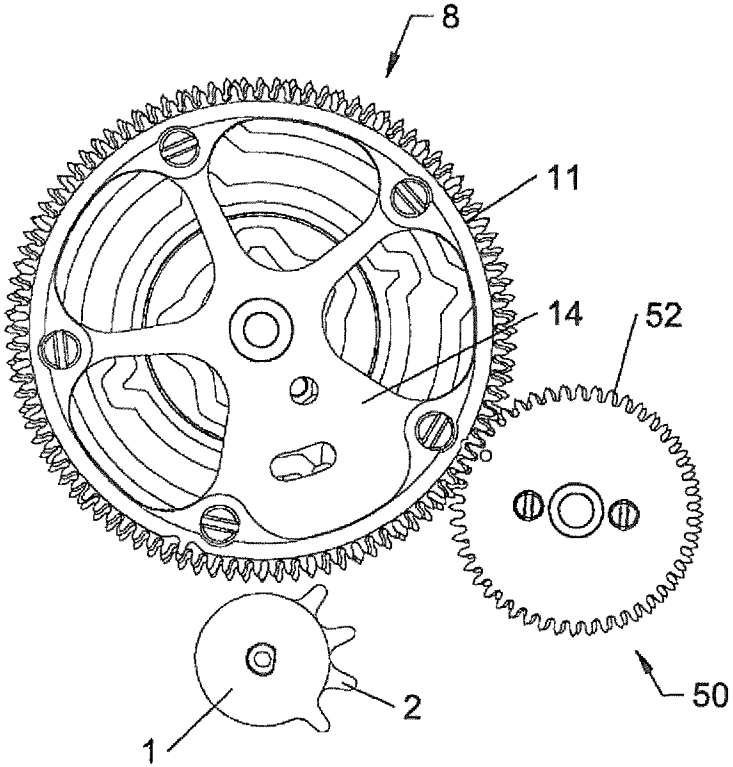
FIG. 3 is a top view of the drive mechanism of the invention.

More specifically in reference to FIGS. 3 and 4, the drive means comprise a drive organ 50 comprising a drive toothing 52 arranged to cooperate with the second toothing 11 of the dates wheel 8, a first driving toothing 54 arranged to cooperate with the coding wheel 16 for the 30- and 31-day months, and a second driving toothing 56 arranged to cooperate with the coding wheel 18 for the months of February with 28 and 29 days. The drive toothing 52 and the first and second driving toothings 54 and 56 are advantageously mounted secured on a same arbor 58.

The dimensions and number of teeth of the different gears used in the invention are chosen to give the coding wheels 16 and 18, and therefore the coding cams 26, 32, 34, a suitable speed of rotation relative to the dates wheel 8, such that the retractable teeth enter the active position at the desired times.

More specifically, the dimensions and number of teeth of the different gears are chosen such that, the dates wheel 8 performing 12 revolutions per year, the coding wheel 16 for the 30- and 31-day months performs 11 revolutions per year, shifting by 30° per month from the dates wheel 8, and the coding wheel 18 for the months of February with 28 and 29 days performs 47 revolutions in 4 years, shifting by 7.5° per month from the dates wheel 8.

Additionally, the coding cams may be arranged to give the drive wheel the shape of a circular or noncircular gear.

Figure 10:
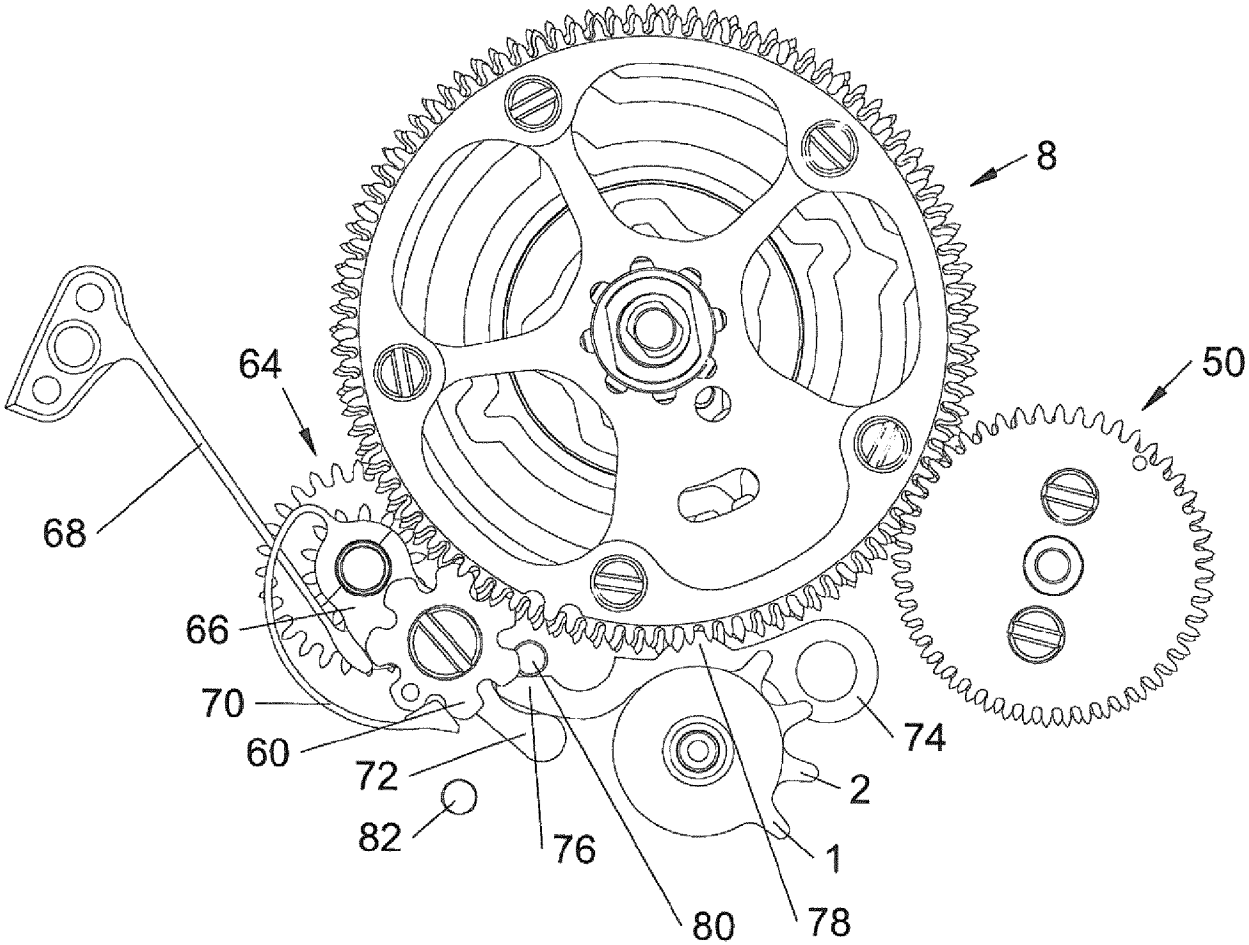
FIG. 10 shows a top view of the drive mechanism according to the invention associated with a mechanism for driving an indicator of the day of the week in the inactive position.
Figure 11:
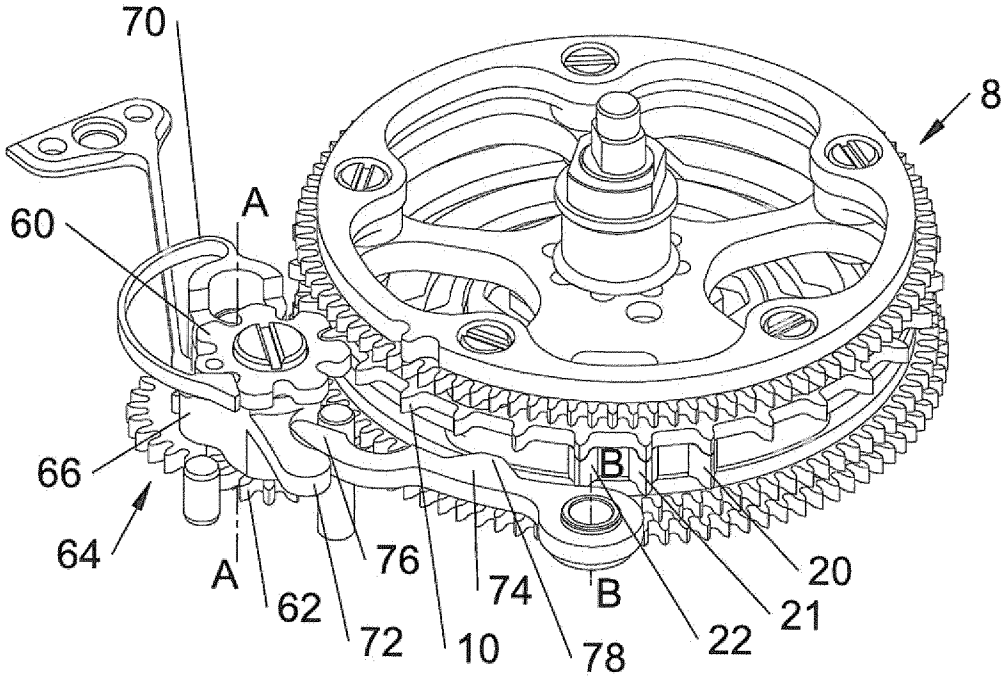
FIG. 11 is an isometric view of the mechanism according to the invention showing the drive mechanism of the invention associated with a mechanism for driving an indicator of the day of the week in the inactive position.
Figure 12:
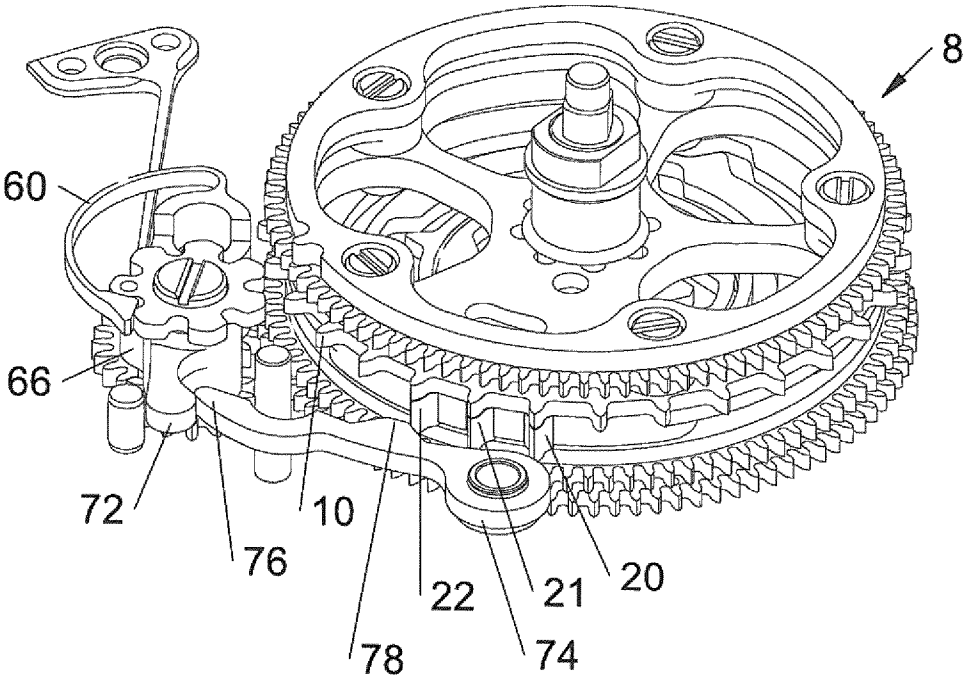
FIG. 12 is an isometric view of the mechanism according to the invention showing the drive mechanism of the invention associated with a mechanism for driving an indicator of the day of the week in the active position.

Additionally, the mechanism for driving a perpetual calendar indicator according to the invention may be associated with a mechanism for driving an indicator of the day of the week, as shown in FIGS. 10 to 12. This mechanism for driving an indicator of the day of the week comprises a days wheel 60, comprising seven teeth, arranged to cooperate with the first toothing 10 with 31 teeth of the dates wheel 8.

The days wheel 60 is secured in rotation to a pinion 62, the first element of a gear train 64 making it possible to kinematically connect the days wheel 60 to an indicator of the days of the week (not shown).

The days wheel 60 and the pinion 62 are pivotably mounted on a lever 66, which in turn is pivotably mounted on the frame around an axis AA. A return spring 68 is provided bearing on the lever 66, as well as a jumper 70 making it possible to keep the days wheel 60 in position.

The lever 66 comprises a beak 72, the function of which will be described below.

The mechanism for driving an indicator of the day of the week also comprises a control 74 pivotably mounted on the frame around an axis BB. The control 74 comprises a beak 76 arranged to cooperate with the beak 72 of the lever 66 and lift the lever 66 when the control 74 is lifted.

Additionally, the control 74 comprises a protruding zone 78 arranged to cooperate with the retractable teeth 20, 21 and 22 when the latter are in the active position.

The mechanism for driving an indicator of the day of the week is positioned such that the retractable teeth 20, 21 and 22 can cooperate on the one hand with the second drive pinion 2, and the other hand with said protruding zone 78. To that end, said retractable teeth 20, 21 and 22 have a sufficient thickness to be able to actuate both with the second drive pinion 2 and the protruding zone 78 when they are in the active position.

Thus, the control 74 and the lever 66 (and therefore the days wheel 60) are arranged to evolve between two positions, namely an inactive position and an active position.

The inactive position, as shown in FIGS. 10 and 11, is the position in which none of the retractable teeth 20, 21 and 22, in the inactive position, cooperate with the control 74, such that the days wheel 60 meshes with the first toothing 10 of the dates wheel 8.

The active position, as shown in FIG. 12, is the position in which at least one of the retractable teeth 20, 21 and 22, in the active position, cooperates with the protruding zone 78 of the control 74, so as to lift the lever 66 such that the days wheel 66 is freed from the first toothing 10 of the dates wheel 8.

Two pins 80 and 82 on either side of the lever 66 and the control 74 make it possible to limit their movement.

Thus, during the 31-day months, the control 74 remains in the inactive position and is maintained under the effect of a return spring (not shown), such that the days wheel 60 meshes with the dates wheel 8 and is driven at a rate of one step per day to display the date. During the months with fewer than 31 days, the control 74 is lifted, one, two or three times depending on the number of days in the month, under the action of one, two or three retractable teeth 20, 21, 22 in the active position, which results in freeing the days wheel 60 from the dates wheel 8. Thus, the displayed day remains fixed while the dates wheel 8 advances by the number of additional steps relative to its regular advancement.

The mechanism for driving an indicator of the day of the week makes it possible to increment the indication of the day of the week by only one day, including the months with fewer than 31 days.

Additionally, due to its construction, the mechanism for driving an indicator of the day of the week operates in both directions. In fact, in case of correction in the opposite direction by a user, the days will be correctly decremented, taking the length of the month into account.

The operation of the mechanism for driving a perpetual calendar indicator according to the invention is as follows:

Each day, the first drive pinion 1 meshes with the first toothing 10 of the dates wheel 8 such that it advances by one step per day, such that the date advances by one step per day. The retractable teeth 20, 21 and 22 are in the inactive position, such that the second drive pinion 2 has no action on the dates wheel 8. The dates wheel 8 advancing by stepping, its second toothing 11 meshes with the drive toothing 52, in turn driving the first and second driving toothings 54 and 56, which in turn rotate the coding wheels 16 and 18, respectively. In parallel, the retractable teeth 20, 21 and 22 being carried by the dates wheel 8, the respective blom studs 30, 38 and 42 move in their respective tracks 28, 36 and 40 of the associated coding cams 26, 32 and 34.

Figure 5:
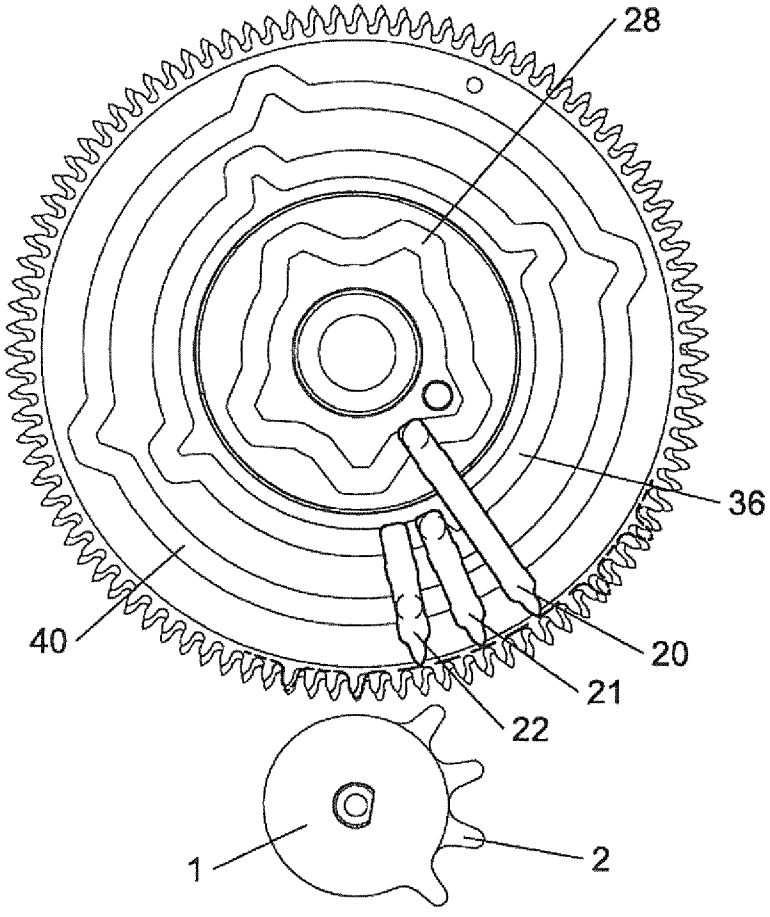
FIG. 5 shows a simplified top view of the drive mechanism according to the invention, in a configuration for the 31-day months.

In reference to FIG. 5, during the 31-day months, the movement of the blom studs 30, 38 and 42 of the retractable teeth 20, 21, 22, in the tracks 28, 36 and 40 during the rotation of the dates wheel 8, combined with the rotation of the coding wheels 16 and 18, makes it such that, owing to the appropriate configuration of the coding cams 26, 32 and 34, the blom studs 30, 38 and 42 of the retractable teeth 20, 21, 22 remain in the hollows of the tracks 28, 36 and 40, such that all of the retractable teeth 20, 21, 22 are in the inactive position inside the dates wheel 8. As a result, during the date change on the 31st day of the month, only one jump being needed, only the tooth of the first drive pinion 1 meshes with the first toothing 10 of the dates wheel 8, which only advances by a single step, to display the first day of the following month. Likewise, the days wheel 60 engaged with the first toothing 10 advances to increment the day of the week indicator by one day.

Figure 6:
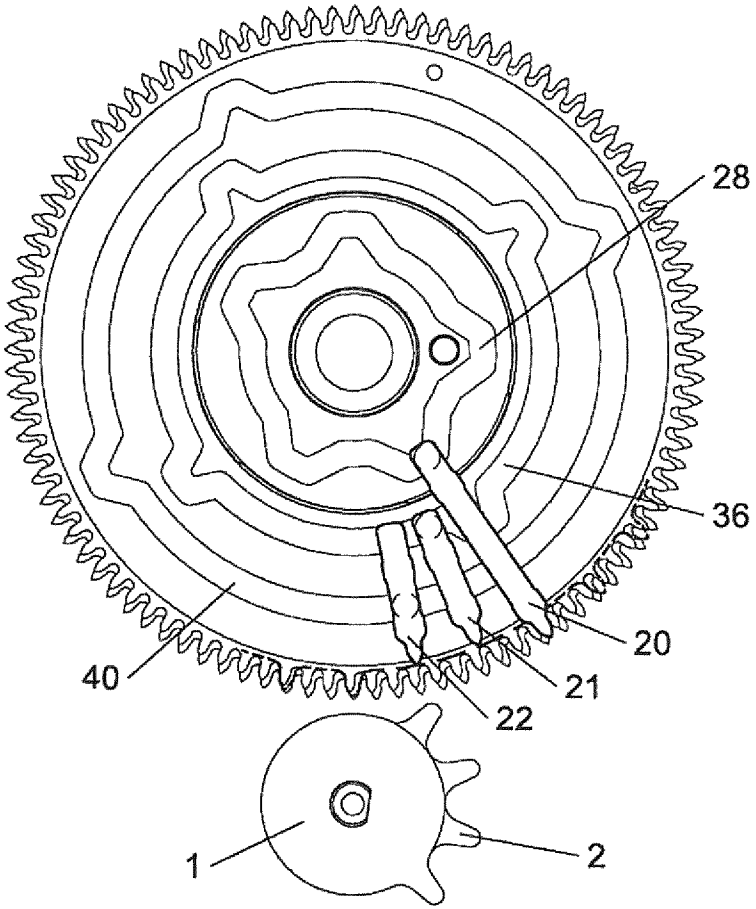
FIG. 6 shows a simplified top view of the drive mechanism of the invention, in a configuration for the 30-day months.

In reference to FIG. 6, during the 30-day months, the movement of the blom studs 30, 38 and 42 of the retractable teeth in the tracks 28, 36 and 40 during the rotation of the dates wheel 8, combined with the rotation of the coding wheels 16 and 18, makes it such that, owing to the suitable configuration of the coding cams 26, 32 and 34, on the last day of the month, i.e., the 30th, the blom stud 30 of the retractable tooth 20 associated with the 30-day month reaches a point of the track 28 of the coding cams 26 associated with the 30-day month, and the blom studs 38 and 42 of the retractable teeth 21 and 22 remain in the hollows of the tracks 36 and 40 of the coding cams 32 and 34. Thus, the retractable tooth 20 slides radially in its recess and enters the active position to mesh with the second drive pinion 2, the two retractable teeth 21 and 22 remaining in the inactive position inside the dates wheel 8. As a result, during a date change on the last day of the month, i.e., the 30th, two jumps needing to be done, a tooth of the second drive pinion 2 meshes with the retractable tooth 20, causing the dates wheel 8 to advance by one additional step relative to the regular advancement of the dates wheel 8, and the tooth of the first drive pinion 1 meshes with the first toothing 10 of the dates wheel 8, which advances by one step according to its regular advancement, so as to display the first day of the following month. The configuration of the coding cam 26 is such that the retractable tooth 20 regains its inactive position quickly by movement of its blom stud 30 in the associated track 28, such that the following day, the retractable tooth is in the active position.

The retractable tooth 20, by pressing on the protruding zone 78 of the control 74, also causes said control 74 to lift in order to pivot the lever 66 and free the days wheel 60 from the dates wheel 8, such that the displayed day remains fixed while the dates wheel 8 advances by one additional step relative to its regular advancement.

Figure 7:
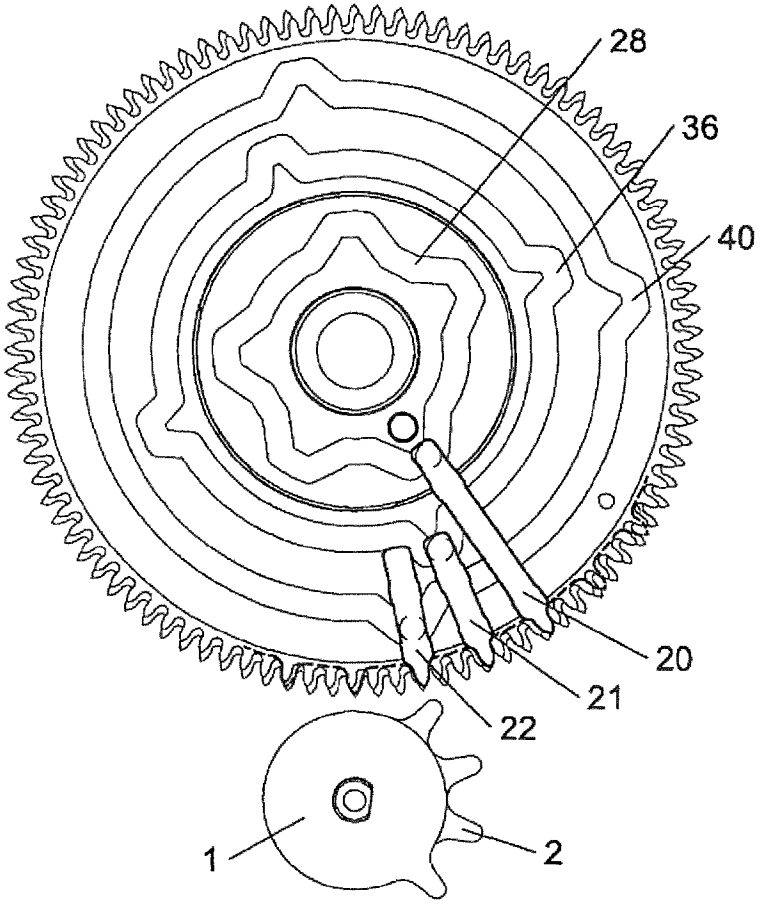
FIG. 7 shows a simplified top view of the drive mechanism according to the invention, in a configuration for the 28-day months.

In reference to FIG. 7, during a month of February with 28 days, the movement of the blom studs 30, 38 and 42 of the retractable teeth in the tracks 28, 36 and 40 during the rotation of the dates wheel 8, combined with the rotation of the coding wheels 16 and 18, makes it such that, owing to the suitable configuration of the coding cams 26, 32 and 34, on the last day of the month, i.e., the 28th, each of the studs 30, 38 and 42 of the retractable teeth 20, 21 and 22 respectively reaches a point in its respective track 28, 36 and 40 of its associated coding cam 26, 32 and 34. Thus, each retractable tooth 20, 21 and 22 slides radially in its recess and enters the active position to mesh with the second drive pinion 2. As a result, during a date change on the last day of the month, i.e., February 28, four jumps being needed, the three teeth of the second drive pinion 2 mesh with the three retractable teeth 20, 21 and 22, causing the dates wheel 8 to advance by three additional steps relative to the regular advancement of the dates wheel 8, and the tooth of the first drive pinion 1 meshes with the first tooth 10 of the dates wheel 8, which advances by one step according to its regular advancement, so as to display the first day of the following month. The configuration of the coding cams 26, 32 and 34 is such that the retractable teeth 20, 21 and 22 regain their inactive position quickly by movement of the blom stud in the associated track, such that on the following day, no retractable tooth is in the active position.

The retractable teeth 20, 21 and 22, by pressing in turn on the protruding zone 78 of the control 74, cause said control 74 to be lifted three times to pivot the lever 66 and release the days wheel 60 from the dates wheel 8, such that the displayed day remains fixed while the dates wheel 8 advances by three additional steps relative to its regular advancement.

Figure 8:
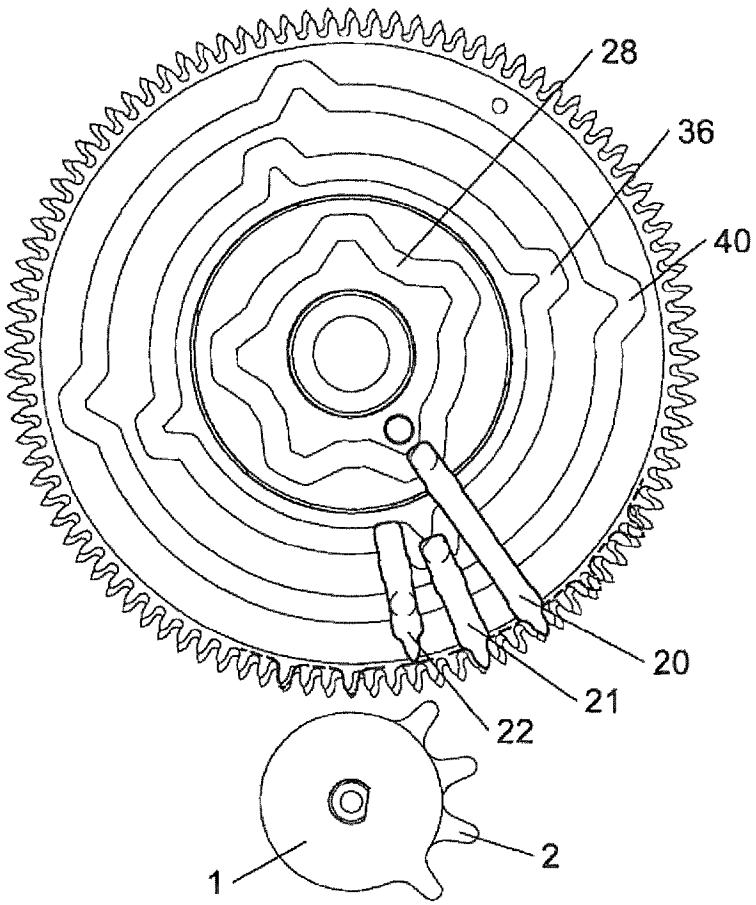
FIG. 8 shows a simplified top view of the drive mechanism according to the invention, in the configuration for the 29-day months.

In reference to FIG. 8, during leap years, for which the month of February comprises 29 days, the movement of the blom studs 30, 38 and 42 of the retractable teeth in the tracks 28, 36 and 40 during the rotation of the dates wheel 8, combined with the rotation of the coding wheels 16 and 18, makes it such that, owing to the suitable configuration of the coding cams 26, 32 and 34, on the last day of the month, i.e., the 29th, the blom stud 30 of the retractable tooth 20 associated with the 30-day months arrives at a point of its track 28 of the coding cam 26 associated with the 30-day months, the blom stud 38 of the retractable tooth 21 associated with the 29-day month reaches a point of its track 36 of the coding cam 32 associated with the 29-day month and the blom stud 42 of the retractable tooth 22 remains in the hollow of the track 40 of the coding cam 34 associated with the month of February with 28 days. Thus, the retractable teeth 20 and 21 slide radially in their respective recesses and enter the active position to mesh with the second drive pinion 2, the retractable tooth 22 remaining in the inactive position inside the dates wheel 8. As a result, during the date change on the last day of the month, i.e., the 29th, three jumps being needed, two teeth of the second drive pinion 2 mesh with the retractable teeth 20 and 21, causing the dates wheel 8 to advance by two additional steps relative to the regular advancement of the dates wheel, and the tooth of the first drive pinion 1 meshes with the first toothing 10 of the dates wheel 8, which advances by one step according to its regular advancement, so as to display the first day of the following month. The configuration of the coding cams 26 and 32 is such that the retractable teeth 20 and 21 regain their inactive position quickly by movement of their blom stud in the associated track, such that on the following day, no retractable tooth is in the active position.

The retractable teeth 20 and 21, by pressing in turn on the protruding zone 78 of the control 74, cause said control 74 to be lifted two times in order to pivot the lever 66 and release the days wheel 60 from the dates wheel 8, such that the displayed day remains fixed while the dates wheel 8 advances by two additional steps relative to its regular advancement.

Thus, the drive mechanism according to the invention does not require any return spring to move the retractable teeth. It therefore uses less energy and is more robust than the mechanisms using return springs.

Furthermore, the drive mechanism according to the invention uses a reduced number of components, said components having a simple construction. The mechanism for driving a perpetual calendar indicator is therefore of a particularly simple construction relative to the traditional mechanisms for driving a perpetual calendar indicator. The main elements of the mechanism according to the invention are superimposed, such that a very compact mechanism is obtained. Additionally, the cams, coding wheels and drive means having toothings permanently kinematically connected with the dates wheel, the drive mechanism according to the invention can be used for the bidirectional correction of the date indicator.

Lastly, the tracks located on the coding cams allow precise positioning of the retractable teeth, which prevents the latter from moving in case of impact.

It is clear that the present invention is not limited to the described embodiment. In particular, the mechanism could include only one first retractable tooth and one first coding cam associated with the 30-day months to obtain an annual date indicator. The number of retractable teeth may be modified to produce other types of date indicator, such as a leap year date indicator: in that case, there is a second retractable tooth and a second coding cam that are associated with the month of February with 29 days, the third retractable tooth and the third coding cam associated with the month of February with 28 days being eliminated. In that case, a manual correction is provided to correct the date at the end of the month of February with 28 days.

It is also possible to provide that the coding wheel for the months of February with 28 and 29 days are separated into two independent wheels respectively carrying the corresponding coding cam, the drive organ then comprising an additional drive toothing. Additionally, the toothings of the drive organ may be separated by providing several drive organs or arranged differently, but still so as to kinematically connect the dates wheel to the coding wheels according to appropriate speed ratios.

In the present alternative, the retractable teeth are arranged such that they translate in their recesses in a horizontal plane x-y. In other alternative embodiments that are not shown, the retractable teeth may be arranged such that they translate along a vertical axis z or by rotation in a horizontal plane x-y. For example, the retractable teeth may be positioned such that the longitudinal axis is not perpendicular to the axis of rotation of the drive wheel. These teeth cooperate with a toothing positioned in a plane, which may or may not be parallel, situated at a different level from the plane defined by the drive wheel.

In another alternative embodiment that is not shown, additional retractable teeth may be provided to circulate in the coding cams already occupied by a retractable tooth used for the date indicator, said additional retractable teeth being used to actuate another mechanism.

In another alternative embodiment that is not shown, the drive pinions may be made up of a wheel similar to the drive wheel described above. In other alternatives, it is also possible to associate other drive wheels as described above with the drive wheel cooperating with the first drive pinion described above.

In the example described above, the mechanism according to the invention makes it possible to drive a perpetual calendar indicator, but it can clearly be used to drive an indicator of any other cyclical or noncyclical information. For example, the cyclical information may be the moon phases or other cyclical information resulting from any type of calendar comprising cycles, for example the Gregorian calendar. The noncyclical information may for example come from the Chinese calendar, and may be the months. In that context, sets of coding cams are provided for which each month is programmed, the coding cams being configured to be changed after a certain amount of time. This time interval between two changes of sets of coding cams will be defined as a function of the size of the system and may for example be every 20 to 30 years, or any other duration.

The invention claimed is:

1. A mechanism for driving an indicator of information connected to a clockwork movement and varying over several periods, during each of which said information evolves step by step, up to a maximum value varying between n and n−m, said mechanism comprising:

a first set of first drive pinions supplied with energy by the movement, a drive wheel comprising a first toothing arranged to mesh with the first set of first drive pinions to advance by n steps per period, a second set of second drive pinions supplied with energy by the movement, the first and second sets of drive pinions being positioned relative to one another such that they do not cooperate at the same time with the drive wheel, m retractable teeth carried by the drive wheel, each being arranged to move between at least two positions, namely an active position for meshing with one of the second drive pinions of the second set of second drive pinions and advancing the drive wheel by one additional step, and an inactive position for not cooperating with said second drive pinion, coding cams, each associated with at least one retractable tooth, and coding wheels secured with said coding cams, the number of coding cams being comprised between 1 and m and the number of coding wheels being less than or equal to the number of coding cams, each coding cam being associated with at least one minimum value n−x of the information, x comprised between 1 and m, for a period, and arranged both to cause the associated retractable tooth to go from the active position to the inactive position and from the inactive position to the active position upon each period for which the maximum associated value of the information is a value comprised between n−m and n−x, and drive means arranged to kinematically connect the drive wheel to each of the coding wheels and arranged to impart a suitable speed of rotation to the coding cams relative to the drive wheel, such that, when the information reaches a maximum value n−x for a period, x retractable teeth enter the active position, then return to the inactive position, the drive wheel advancing by x additional steps for that period, n, m and x being natural integers, m being ≥1, wherein each retractable tooth comprises a stud and the corresponding coding cam associated with a maximal value n−x of the information comprises a track in which the stud can circulate, the track having a suitable configuration such that the retractable tooth remains in its inactive position upon each period for which the associated maximal value of the information is a value comprised between n−x+1 and n, and such that the retractable tooth moves from its inactive position toward its active position upon each period for which the associated maximal value of the information is a value comprised between n−m and n−x, and then returns to its inactive position after having cooperated with the second drive pinion.

2. The mechanism according to claim 1, wherein the driving means comprise a drive organ comprising a drive toothing arranged to cooperate with the drive wheel and a number of driving toothings equal to the number of coding wheels, said driving toothings being arranged to cooperate with the coding wheels, the drive toothing and the driving toothings being chosen so as to obtain a suitable speed ratio between the drive wheel and each of the coding cams.

3. The mechanism according to claim 2, wherein the drive toothing and the driving toothings are mounted on a same arbor.

4. The mechanism according to claim 2, wherein the drive wheel comprises a second toothing to cooperate with the drive means.

5. The mechanism according to claim 1, wherein the drive wheel comprises a second toothing to cooperate with the drive means.

6. The mechanism according to claim 1, wherein the coding wheels, the coding cams and the drive wheel are coaxial.

7. The mechanism according to claim 1, wherein the first and second sets of drive pinions comprise a first, second drive pinion, respectively, said first and second drive pinions being secured to each other.

8. The mechanism according to claim 1, wherein it comprises a first retractable tooth and a first coding cam associated with the 30-day months, a second retractable tooth and a second coding cam associated with the month of February with 29 days, and a third retractable tooth and a third coding cam associated with the month of February with 28 days, and wherein the drive wheel is a dates wheel with 31 teeth arranged to advance by one step per day.

9. The mechanism according to claim 8, wherein the first coding cam associated with the 30-day months is secured to a coding wheel for the 30- and 31-day months, wherein the second coding cam associated with the month of February with 29 days and the third coding cam associated with the month of February with 28 days are secured to a same coding wheel for the month of February with 28 and 29 days.

10. The method according to claim 9, wherein the drive means comprise a drive organ comprising a drive toothing arranged to cooperate with the dates wheel, a first driving toothing arranged to cooperate with the coding wheel for the 30- and 31-day months, and a second driving toothing arranged to cooperate with the coding wheel for the months of February with 28 and 29 days.

11. The mechanism according to claim 10, wherein the toothings of the dates wheel and drive organ are such that, the dates wheel performing 12 revolutions per year, the coding wheel for the 30- and 31-day months performs 11 revolutions per year, shifting by 30° per month from the dates wheel, and the coding wheel for the months of February with 28 and 29 days performs 47 revolutions in 4 years, shifting by 7.5° relative to the dates wheel.

12. The mechanism according to claim 1, wherein it comprises a mechanism for driving an indicator of the day of the week, said mechanism for driving an indicator of the day of the week comprising a days wheel arranged to cooperate with the first toothing of the drive wheel when the retractable teeth are in the inactive position, and to be released from the first toothing of the drive wheel when at least one of the retractable teeth is in the active position.

13. The mechanism according to claim 12, wherein the mechanism for driving an indicator of the day of the week further comprises a lever on which the days wheel is mounted and a control cooperating with said lever, said control having a protruding zone arranged to cooperate with at least one of the retractable teeth when the latter are in the active position, so as to lift said control and the lever and free the days wheel from the first toothing of the drive wheel.

* * * * *